US005324613A

United States Patent [19]

Ciccarelli et al.

[11] Patent Number: 5,324,613

[45] Date of Patent: * Jun. 28, 1994

[54] TONER AND DEVELOPER COMPOSITIONS

[75] Inventors: Roger N. Ciccarelli, Rochester; Denise R. Bayley, Fairport; Jacques C. Bertrand, Ontario; Thomas R. Pickering, Webster, all of N.Y.

[73] Assignee: Xerox Corporation, Stamford, Conn.

[ * ] Notice: The portion of the term of this patent subsequent to Jun. 29, 2010 has been disclaimed.

[21] Appl. No.: 992,313

[22] Filed: Dec. 21, 1992

Related U.S. Application Data

[63] Continuation of Ser. No. 755,919, Sep. 6, 1991, Pat. No. 5,223,368.

[51] Int. Cl.[5] ..... G03G 9/097

[52] U.S. Cl. ..... 430/110; 430/106; 430/108; 430/109

[58] Field of Search ..... 430/110, 106, 109, 108

[56] References Cited

U.S. PATENT DOCUMENTS 4,845,003 7/1989 Kiriu et al. ..... 430/110

*Primary Examiner*—Marion E. McCamish
*Assistant Examiner*—Rosemary Ashton
*Attorney, Agent, or Firm*—E. O. Palazzo

[57] ABSTRACT

A toner containing resin, pigment and an aluminum hydroxide charge additive, or the hydrates thereof, and developer compositions with the aforementioned toner and imaging processes thereof are disclosed.

22 Claims, 2 Drawing Sheets

TONER AND DEVELOPER COMPOSITIONS

This is a continuation of application Ser. No. 755,919, filed Sep. 6, 1991 now U.S. Pat. No. 5,223,368.

BACKGROUND OF THE INVENTION

The present invention relates to toner and developer compositions, and more specifically to toner compositions comprised of novel charge enhancing additives. In an embodiment, the present invention is related to negatively charged toner compositions comprised of resin, pigment, and the aluminum hydroxide charge enhancing additives, such as aluminum salts of alkylated salicylic acid, like for example hydroxy bis[3,5-tertiary butyl salicylic] aluminate. Also, the present invention relates to developer compositions comprised of the toners illustrated herein, and carrier particles, including those with a coating thereover. Processes for the preparation of the charge enhancing additives selected are also encompassed by the present invention. The toners and developers of the present invention can be selected for a number of electrophotographic imaging and printing processes including known xerographic processes. Also, the toners and developers of the present invention can be utilized for color inclusive of trilevel color xerography reference U.S. Pat. No. 4,948,686, U.S. Pat. No. 5,208,129, U.S. Pat. No. 5,212,036, and full process color, U.S. Pat. No. 5,275,905, the disclosures of which are totally incorporated herein by reference. In an embodiment, the present invention is directed to imaging processes, a process for forming two-color images, and more specifically to a process for obtaining two-color images which in an embodiment comprises charging an imaging member, creating on the member a latent image comprising areas of high, medium, and low potential, developing the low areas of potential with a toner composition, subsequently developing the high areas of potential with a toner composition, transferring the developed image to a substrate, and optionally permanently affixing the image to the substrate. Another embodiment of the present invention relates to processes for obtaining two color images which comprises charging an imaging member, creating on the member a latent image comprising areas of high, medium, and low potential, developing the low areas of potential with a developer composition comprised of a negatively charged toner with aluminum hydroxide charge enhancing additives, such as the aluminum salts of alkylated salicylic acid or the hydrates thereof, subsequently developing the high areas of potential with a developer composition comprised of a colored toner, especially a blue toner containing a second charge enhancing additive, transferring the developed images to a substrate, and permanently affixing the images to the substrate by, for example, heat or a combination of heat and pressure. One advantage associated with the imaging processes of the present invention is the ability to generate high quality two-color images in a single development pass, particularly as a result of the absence of interaction between the colored, excluding black, and the black developers in an embodiment of the present invention. Other advantages associated with the present invention include the provision of a developer with substantially stable negative triboelectrical toner characteristics and stable negative triboelectrically charged toner which enables the generation of high quality images subsequent to development, that is images with substantially no background deposits and substantially no smearing for a broad range of relative humidity conditions, that is for example from between about 20 to 90 percent relative humidity at an effective range of, for example, temperature zones ranging, for example, from between about 20° C. to about 80° C.

Toners with certain aluminum charge enhancing additives are known, reference U.S. Pat. No. 4,845,003, the disclosure of which is totally incorporated herein by reference. The charge additives of the aforementioned patent comprise an aluminum compound of a hydroxycarboxylic acid which may be substituted with alkyl and/or aralkyl, reference the Abstract for example. Infrared analysis of a number of the aluminum charge enhancing additives of the '003 patent indicates the presence of free 3,5 di-t-butylsalicylic acid in significant amounts. Infrared analysis of the charge additives of the present invention indicate that no free acid, or substantially no free acid is present. Also, the toner/developer performance properties and characteristics of the present invention are superior in some respects as compared, for example, to the toners of the '003 patent. For example, as evidenced by the working Examples provided hereinafter toners with the charge enhancing additives of the present invention possess substantially lower CWS and CLC than toners of the '003 patent; CWS=Corrected Wrong Sign toner and CLC=Corrected Low Charge as determined by Charge Spectra analyses. The aforementioned lower characteristics with the toners of the present invention in embodiments enable, for example, developed images of excellent color, excellent image resolution with substantially no background deposits, and substantially stable triboelectric characteristics.

Toners with charge enhancing additives including additives that assist in providing a negative charge to the toner, such as orthohalocarboxylic acids, certain metal complexes and the like are known. Also known are positively charged toners, reference for example U.S. Pat. Nos. 4,298,672; 4,338,390 and 4,560,635, the disclosures of which are totally incorporated herein by reference.

In a patentability search report the following United States Patents were recited: U.S. Pat. No. 4,845,003 discussed herein; U.S. Pat. No. 4,656,112, which discloses, for example, toners with a zinc complex compound of an aromatic hydroxycarboxylic acid with or without a substituent as a charge agent, see the Abstract, and column 2; and as background interest U.S. Pat. No. 4,411,974.

Processes for obtaining electrophotographic, including xerographic, and two-colored images are known. In U.S. Pat. No. 4,264,185, the disclosure of which is totally incorporated herein by reference, there is illustrated an apparatus for forming two-color images by forming a bipolar electrostatic image of a two-color original document on a photoconductive drum. A first developing unit applies a toner of a first color and polarity to the drum and a second developing unit applies a toner of a second color and polarity to the drum to form a two-color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821 there is disclosed a method and apparatus for forming two-color images which employs two magnetic brushes. The first developed image is not disturbed during development of the second image since the second magnetic brush contacts the surface of the imaging member more lightly than the first magnetic brush, and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second nonmagnetic sleeve and the surface of the imaging member. In addition, the toners selected may have different quantities of electric charge.

Further, U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography which comprises two kinds of developers, each of which are comprised of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Additionally, U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

In addition, U.S. Pat. No. 4,500,616 discloses a method of developing electrostatic latent images by selectively extracting colored grains of one polarity from a mixture containing colored grains having opposite polarity to each other in the presence of an alternating field, followed by development of the electrostatic image by the selectively extracted colored grains. Further, U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image to develop the noncharged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

Furthermore, in U.S. Pat. No. 4,525,447, the disclosure of which is totally incorporated herein by reference, there is illustrated an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier. Also, U.S. Pat. No. 4,539,281 discloses a method of forming dichromatic copy images by forming an electrostatic latent image having a first image portion and a second image portion. The first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a nonmagnetic toner of a second color chargeable to a polarity opposite to that of the magnetic toner by contact with the magnetic carrier.

Additionally, U.S. Pat. No. 4,562,129, the disclosure of which is totally incorporated herein by reference, illustrates a method of forming dichromatic copy images with a developer composed of a high-resistivity magnetic carrier and a nonmagnetic insulating toner, which are triboelectrically chargeable. An electrostatic latent image having at least three different levels of potential is formed and the toner and carrier are adhered, respectively, onto the first and second image portions. In addition, U.S. Pat. No. 4,640,883, the disclosure of which is totally incorporated herein by reference, illustrates a method of forming composite or dichromatic images which comprises forming on an imaging member electrostatic latent images having at least three different potential levels, the first and second latent images being represented, respectively, by a first potential and a second potential relative to a common background potential.

The following United States patents are mentioned: U.S. Pat. No. 4,845,004 directed to hydrophobic silicon type micropowders comprising silicon type microparticles which have been treated with secondary tertiary amine functional silanes, and when the micropowders combine with the positively charging resin powder, such as a toner, the fluidity of the resin powder is substantially increased, see for example the Abstract of the Disclosure, column 1, beginning at line 60, and continuing on to column 4, and the working Examples; U.S. Pat. No. 4,758,491 directed to dry toner and developer compositions with good charge stability and minimization of toner image transfer defects, which composition comprises a major component of a normally solid fixable binder resin which is free of siloxane segments and is a minor component in a normally solid multiphase thermoplastic condensate polymer which contains a polyorgano siloxane block or graft segment, note specifically the use of a charge control agent in column 2, beginning at line 50, examples of charge control agents being detailed, for example, in column 4, beginning at line 23, including ammonium or phosphonium salts, and the like; U.S. Pat. No. 4,845,003 directed to a toner for developing electrostatic latent images characterized in that the toner comprises an aluminum compound of a hydroxy carboxylic acid which may be substituted with alkyl and/or arylalkyl, see for example column 2, beginning at line 29, and continuing on to column 5, it being noted that the aluminum complex compounds of this patent may be selected as the charge enhancing additive component for one of the developer compositions of the present invention comprised of resin pigment, excluding black, the disclosure of this patent being totally incorporated herein by reference; and U.S. Pat. No. 4,855,208 directed to a toner for developing electrostatic latent images, which toner comprises an aluminum compound of an aromatic amino carboxylic acid as represented by the formula illustrated in the Abstract of the Disclosure, and also see column 2, beginning at line 26, and continuing on to column 7. The aluminum compound of the '208 patent may be selected in an embodiment as a charge enhancing additive for the colored toner and developer, that is developer without black pigment, of the present invention.

Other representative patents of interest with respect to formation of two-color images include U.S. Pat. Nos. 4,045,218 and 4,572,651.

The process of charging a photoresponsive imaging member to a single polarity and creating on it an image consisting of at least three different levels of potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the trilevel process for generating images is U.S. Pat. No. 4,686,163, the disclosure of which is totally incorporated herein by reference.

Illustrated in U.S. Pat. No. 4,948,686, the disclosure of which is totally incorporated herein by reference, is a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the process of the copending application may be of any type capable of maintaining three distinct levels of potential. Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like.

Toners with certain zinc or aluminum salicylate complex charge enhancing additive in admixture with a second nonmetal containing charge enhancing additive are illustrated in copending application U.S. Ser. No. 755,979, the disclosure of which is totally incorporated herein by reference. The toner compositions of the aforementioned patent application contain, for example, a mixture of a zinc 3,5-di-tert-butyl salicylate compound and an alkyl pyridinium halide compound as the charge control additive mixture, a resin, a colorant, a colloidal silica external additive, and a metal salt of a fatty acid external additive.

A developer composition with a toner containing a resin, a colorant, a charge control agent, and colloidal silica external additive particles and a carrier with a core, an optional coating on the core, and an external additive selected from the group consisting of metal salts of fatty acids, linear polymeric alcohols comprising a fully saturated hydrocarbon chain with at least about 80 percent of the polymeric chains terminated at one end with a hydroxyl group are illustrated in U.S. Pat. No. 5,171,653 entitled "IMPROVED ELECTROSTATIC DEVELOPING COMPOSITION AND PROCESS", the disclosure of which is totally incorporated herein by reference. The charge control additives of the aforementioned patent include, for example, dimethyl distearyl ammonium methyl sulfate.

In U.S. Pat. No. 5,075,185, the disclosure of which is totally incorporated herein by reference, there is illustrated a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the aforementioned patent, the first developer comprises, for example, a first toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; a first colored blue, especially PV FAST BLUE®, pigment present in an effective amount of from, for example, about 1 to about 15 percent by weight, and preferably from about 1 to about 3 weight percent; an aluminum complex charge enhancing additive, such as those illustrated in the '003 patent; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in a preferred embodiment the black toner is comprised of 92 percent by weight of a styrene n-butyl methyacrylate copolymer (58/42), 6 percent by weight of REGAL 330® carbon black, and 2 percent by weight of the charge enhancing additive cetyl pyridinium chloride. The aforementioned toners may include as surface or external components additives in an effective amount of, for example, from about 0.1 to about 3 weight percent, such as colloidal silicas, metal salts, metal salts of fatty acids, reference for example U.S. Pat. Nos. 3,590,000; 3,655,374; 3,900,588 and 3,983,045, the disclosures of which are totally incorporated herein by reference, metal oxides and the like for the primary purpose of controlling toner conductivity and powder flowability.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected. Similar imaging processes are envisioned for the toners and developers of the present invention.

Formula 1A is a general formula for hydroxy aluminum complex charge control additives derived, for example, from the reaction of an aluminum salt with a salicylic acid compound. Formula 1B is a general formula for hydroxy aluminum complex charge control additives obtained, for example, from the reaction of an aluminum salt with a hydroxy naphthoic acid compound. In both Formulas 1A and 1B the aromatic portion of the complexing acid may be substituted with alkyl groups as represented by $(R_1)_n$ wherein $R_1$ is hydrogen or an alkyl group, and wherein n is an integer of from 0 to 4.

Figure 2A:
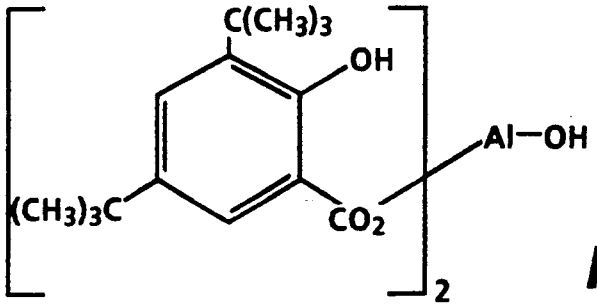
Figure 2B:
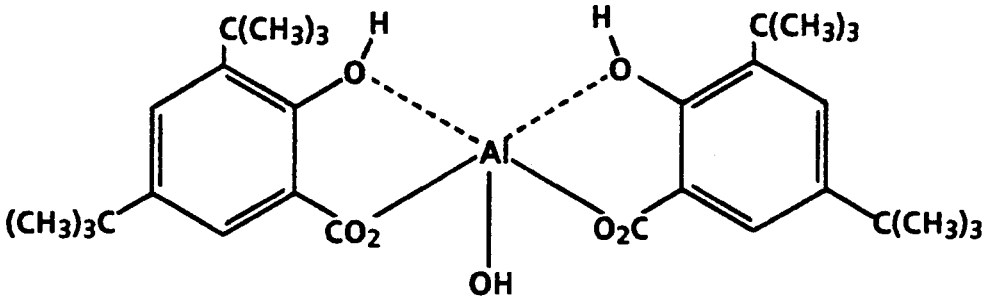
Figure 2C:
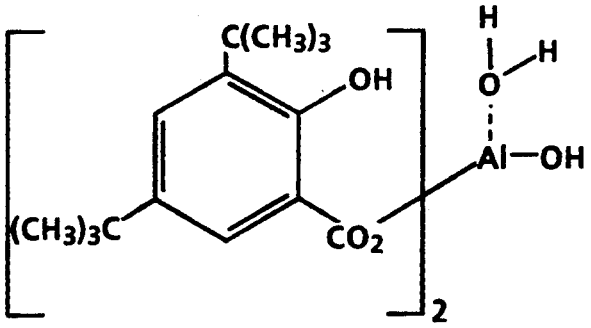

Embodiments of specific charge enhancing components of the present invention are illustrated in FIGS. 2A, 2B and 2C. These additives can be obtained by the reaction of two equivalents of the sodium salt of, for example, 3,5-di-tert-butyl salicylic acid with one half equivalent of a dialuminum salt, for example aluminum sulfate, $Al_2(SO_4)_3$, in an aqueous alkali solution which generates a 2:1 complex of two salicylic acid molecules about a single central aluminum atom wherein both carboxylate groups of the salicyclic acid moeities are covalently bonded through the carboxylate oxygen atom to the aluminum atom. It is also believed that the hydroxy aluminum complex compounds of the present invention have a hydroxyl group (—OH) that is covalently-bonded to the aluminum atom (Al), that is an Al—OH, as shown in Formulas 2A, 2B and 2C. Also, the aromatic hydroxyl groups of the salicylic acid may be datively coordinated rather than covalently bonded to the central aluminum atom. The degree of hydration of the hydroxy aluminate complexes may vary as indicated by the subscript x and may be equal to 0, 1, 2, 3, or 4 and may depend upon how vigorously the complex is dried after isolation. It is further believed that the hydroxy aluminate complexes when formed with the processes as illustrated herein in embodiments can form mixtures. The water of hydration is believed to be strongly associated with the aluminum atom and is not easily removed upon heating under vacuum for 24 hours at 100° C. and above. Further, although not being desired to be limited to theory it is believed in embodiments that the negative charge enhancing ability of hydroxy aluminate complexes may derive negative charge directing ability from both the covalently bound hydroxyl group and the water of hydration. These structural features may serve to stabilize the complex and also serve as a reservoir of readily exchangable protons.

SUMMARY OF THE INVENTION

It is a object of the present invention to provide toner and developer compositions.

In another object of the present invention there are provided negatively charged toners.

Another object of the present invention resides in the provision of toners with certain aluminum charge enhancing additives.

It is another object of the present invention to provide toners comprised of resin, pigment, and charge additives comprised of the aluminum salts of alkylated salicylic acid, the hydrates, such as the mono, di, tri and tetrahydrates thereof, or the nonhydrates thereof.

Another object of the present invention resides in the provision of processes for the preparation of novel charge enhancing additives.

It is another object of the present invention to provide imaging processes for forming two-color images.

It is another object of the present invention to provide two-color image formation processes.

It is still another object of the present invention to provide toners and processes for forming two-color images wherein the second developer does not substantially react with, or is triboactively neutral to, the first developed image on the photoreceptor, or photoconductive imaging member.

It is yet another object of the present invention to provide a process for forming two-color images wherein the first developer does not discharge the latent image to be developed by the second developer.

Another object of the present invention is to provide a two-color image formation process wherein the developers are of a specific triboelectric charge, have a certain charge distribution, and possess a certain conductivity, and exhibit acceptable admix times and developer lifetimes.

Still another object of the present invention is to provide a two-color image formation process wherein the two developers exhibit similar rheological properties, thereby enhancing fusing and similar cleaning latitudes, thereby enhancing cleaning of the photoreceptor.

Moreover, in another object of the present invention there are provided two-color image formation processes wherein a black toner with an alkyl pyridinium halide or other similar charge additive, and a colored toner with an aluminum hydroxide charge additive are selected.

These and other objects of the present invention can be accomplished by the provision of toners with certain charge enhancing additives. More specifically the present invention is directed to a toner comprised of resin particles, pigment particles, and a charge additive as represented by the formulas presented in the Figures, or mixtures thereof in embodiments. In one embodiment, the toner of the present invention is comprised of resin, pigment and a charge enhancing additive of the formulas as represented by

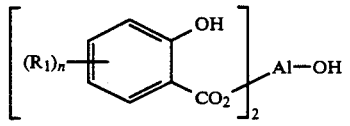

or

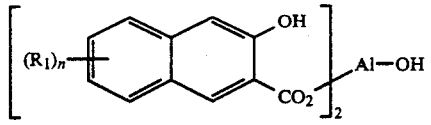

wherein $R_1$ is hydrogen, alkyl with, for example, from 1 to about 25 carbon atoms as illustrated herein and the like, and n represents the number of $R_1$ groups, and can be zero, 1, 2, 3, or 4.

Embodiments of the present invention include a toner wherein $R_1$ is hydrogen, methyl, ethyl, propyl, or butyl, and n is 0 (zero), 1, 2, 3, or 4; and wherein $R_1$ is hydrogen, isopropyl, n-butyl, isobutyl, or tert-butyl and n is 0 (zero), 1, 2, 3, or 4. Also, the present invention relates to developers comprised of the toners illustrated herein, and carrier particles comprised of a core, like steel, ferrites, such as copper zinc ferrites, and the like, and which core may optionally contain thereover a polymeric coating, or mixture of polymers.

The toners of the present invention in embodiments thereof are comprised of resin particles, pigment particles, such as known carbon blacks, including those available from Cabot Corporation, such as REGAL 330® carbon black, colored pigments other than black such as magenta, cyan, yellow, or mixtures thereof, and a charge additive comprised of the hydroxy aluminum complexes of alkylated salicylic acids as illustrated, for example, in the FIGS. 1A, 1B, 2A, 2B and 2C.

Examples of specific charge additives selected for the toners of the present invention include hydroxy bis[3,5-tertiary butyl salicylic] aluminate; hydroxy bis[3,5-tertiary butyl salicylic] aluminate mono-, di-, tri-or tetrahydrates; hydroxy bis[salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; bis[tetraalkylated hydroxy naphthoic acid] aluminate wherein alkyl preferably contains 1 to about 6 carbon atoms; and the like.

The charge additives are present in the toner in various effective amounts, for example from about 0.05 to about 20, and preferably from about 1 to about 5 weight percent. The charge additives of the present invention may in embodiments also be added to the surface of the toner particles or may be included on the toner particles by adding the aluminum charge additive compound onto the surface of small particle metal oxide particles, for example silicon oxides, tin oxides, aluminum oxides, zinc oxides, cerium oxides, titanium oxides, and the like. The toner can possess a negative triboelectic charge of from about 10 to 40, and preferably from about 10 to about 25 microcoulombs per gram as determined by the known Faraday Cage process.

Figure 1A:
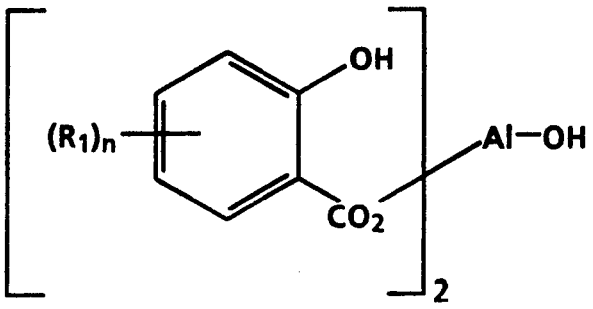
FIGS. 1A, 1B, 2A, 2B and 2C represent formulas of a number of the hydroxy aluminum complex charge control additives of the present invention, anhydrous or hydrates thereof, $XH_2O$, wherein X represents the number of water attachments.
Figure 1B:
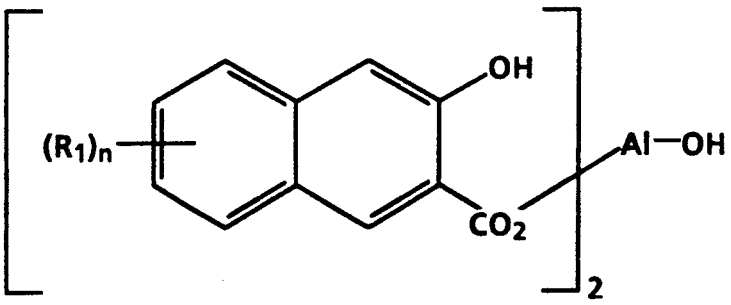

The charge additives of the present invention in embodiments, reference for example the compounds of FIG. 1A can be prepared by the reaction of at least two molar equivalents of the sodium or alkali salt of a salicylic acid derivative wherein $R_1$ is hydrogen or alkyl, with for example from 1 to about 25 carbon atoms as illustrated herein, and wherein n represents the number of $R_1$ groups, and can be zero, 1, 2, 3, or 4, with a one molar aluminum equivalent of an aluminum containing salt, for example using a dialuminum salt such as aluminum sulfate, $Al_2(SO_4)_3$ being about one half molar equivalent. The aluminum salt reactant may be a hydrated compound, for example $Al_2(SO_4)_3.XH_2O$ and wherein X represents the number of water components such as 0 to about 25. The reaction sequence is preferably accomplished by first converting an alpha hydroxy carboxylic acid compound, that is a salicylic acid derivative, for example, when converting the compounds of Formula 1A into the corresponding alkali metal salt, for example sodium, in an aqueous alkali solution. The aqueous alkali solution containing the alkali salt of the alpha hydroxy carboxylate is then added to an acidic aqueous solution containing the aluminum containing salt reactant with rapid stirring. This inverse addition ensures that the complexing aluminum species is initially present in excess relative to the concentration of the added sodium salt. The inverse addition also avoids or minimizes tris- complex formation, [RCO2]3Al, that is a product having three carboxylate containing ligands bonded to the aluminum atom and no hydroxy-aluminum bond. Cooling the reaction mixture to room temperature produces a precipitate that may be collected by filtration. The crude product may be purified further by washing with, for example, water or other suitable solvents until the acidity of the wash water is nearly constant, for example a pH of about 5.5. The product is preferably dried to a constant weight in a vacuum drying oven. The reaction can provide a 2:1 complex of two salicylic acid molecules arranged about a single central aluminum atom wherein both carboxylate groups of the salicylic acid moieties are covalently bonded through the carboxylate oxygen atom to the aluminum atom. It is also believed that of the hydroxy aluminum complex compounds prepared in this manner have a hydroxyl group (—OH) that is covalently bonded to the aluminum atom as shown in Formulas 2A, 2B and 2C.

A similar reaction procedure can be selected to prepare hydroxy aluminate compounds corresponding to Formula 1B except that the reactant alpha hydroxy carboxylic acid compound is selected from alpha hydroxy naphthoic acid or substituted alpha hydroxy naphthoic acid compounds wherein the substituent $(R_1)_n$ is hydrogen or alkyl with, for example, from 1 to about 25 carbon atoms, and n represents the number of $R_1$ groups, and can be zero, 1, 2, 3, or 4.

The following reaction sequence illustrates the preparation of the charge control additives of the present invention wherein the $RCO_2H$ represents the aforementioned salicylic acid or alpha hydoxy naphthoic acid derivative reactants containing the substituent $(R_1)_n$ that are neutralized with base to form the corresponding alkali melt salt of the carboxylic acid, $RCO_2Na$ $$4RCO_2H + 6NaOH \rightarrow 4RCO_2Na + 4H_2O$$

$$4RCO_2Na + 2NaOH + Al_2(SO_4)_3 \rightarrow 2(RCO_2)_2\text{—}Al\text{—}OH + 3Na_2SO_4$$

where $RCO_2H$ is a salicylic acid derivative, for example 3,5-di-tert-butyl salicylic acid, salicylic acid, alkylated salicylic acid, hydroxy naphthoic acid, alkylated hydroxy naphthoic acid, and the like. The salicylic acid may contain one or more substituents $R_1$, reference FIG. 1A and 1B wherein $R_1$ is hydrogen or alkyl, and preferably methyl, ethyl, n-propyl, isopropyl, n-butyl, isobutyl, tert-butyl, $C_5$ alkyl and isomers thereof, and $C_6$ alkyl to $C_{20}$ alkyl and isomers thereof; and n is 0 to 4. $R_1$ can be comprised of a mixture of the groups indicated, especially when n is 2 to 4. The reaction may be performed at effective elevated temperatures, for example greater than about 40° C., and preferably at about 60° C., or at room temperature, about 25° C. The initially formed salicylic acid sodium salt can be added to the aluminum sulfate solution which allows the aluminum to remain in excess during the reaction. The acidity or pH of the reaction mixture may be followed during the reaction and increases from about 2 to about 3 and levels off at about 5.5 when the reaction is complete. The yield of the reaction was about 95 percent based on the weight of the aluminum salt used. Infrared analysis of the products indicated that no free salicylic acid derivative was present; that is, only the hydroxy aluminum complex was present in the product.

In an embodiment of the present invention the imaging process comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a negatively charged first toner comprised of resin particles, colored, other than black, pigment particles, and the aluminum hydroxide charge enhancing additives illustrated herein reference for example FIGS. 1A, 1B, 2A, 2B and 2C, and preferably FIG. 1A and 1B; (4) subsequently developing the high areas of potential by conductive magnetic brush development with a developer comprising a second black developer comprised of carrier particles and a positively charged toner comprised of resin, black pigment, such as carbon black, like those available from Cabot Corporation, such as REGAL 330®, and a second charge enhancing additive that assists in enabling a positive charge on the toner, such as distearyl dimethyl ammonium methyl sulfate; (5) transferring the developed two-color image to a suitable substrate; and (6) fixing the image thereto.

In an embodiment of the present invention, the first developer comprises, for example, a first toner comprised of resin present in an effective amount of from, for example, about 70 to about 98 percent by weight, which resin can be selected from the group consisting of polyesters, styrene butadienes, styrene acrylates, styrene-methacrylate polymers, PLIOLITES®, crosslinked styrene acrylates, crosslinked styrene methacrylates, and the like wherein the crosslinking component is, for example, divinyl benzene, and mixtures thereof; a first pigment, such as a colored blue, like cyan, magenta, yellow, blue, green, brown, red, mixtures thereof, and more specifically a PV FAST BLUE® pigment present in an effective amount of from, for example, about 1 to about 15 percent by weight, and preferably from about 1 to about 3 weight percent; the aluminum hydroxide charge additive illustrated herein, reference FIGS. 1A, 1B, 2A, 2B and 2C; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive, such as an alkyl pyridinium halide, and preferably cetyl pyridinium chloride, and in an embodiment the black toner is comprised of 92 percent by weight of a styrene n-butyl methacrylate copolymer (58/42), 6 percent by weight of REGAL 330® carbon black, and 2 percent by weight of the charge enhancing additive cetyl pyridinium chloride, or distearyl dimethyl ammonium methyl sulfate. The aforementioned toners may include as surface or external components additives in an effective amount of, for example, from about 0.1 to about 3 weight percent, such as colloidal silicas, metal salts, metal salts of fatty acids, reference for example U.S. Pat. Nos. 3,590,000; 3,655,374; 3,900,588 and 3,983,045, the disclosures of which are totally incorporated herein by reference, metal oxides and the like for the primary purpose of controlling toner conductivity and powder flowability.

Each of the toner resins can be comprised of known polymers such as those illustrated herein, and in the U.S. patents mentioned herein, such as styrene acrylates, styrene methacrylates, crosslinked styrene acrylates, styrene methacrylates, wherein the crosslinking component can, for example, be a divinylbenzene; and more specifically styrene butylmethacrylate (58/42). Also, known suspension polymerized styrene butadienes and emulsion polymerized styrene butadienes may be selected as the toner resin.

Carriers that may be selected to form the developers include those comprised of cores of steel, ferrites, such as copper zinc ferrites, other known ferrites, iron, sponge iron, and the like. The carrier cores may be coated with an effective amount of polymers, either with a continuous or semicontinuous coating, wherein the coating weight in embodiments is from about 0.1 to about 3 weight percent. Examples of coatings include fluoropolymers, such as KYNAR® terpolymers of styrene, methacrylate and an organosilane, chlorotrifluoroethylene-vinyl chloride copolymers, chlorotrifluoroethylene-vinylacetate copolymers, polymethacrylate, and the like. Also, there may be selected the carriers of U.S. Pat. Nos. 4,937,166 and 4,935,326, the disclosures of which are totally incorporated herein by reference.

Examples of imaging members selected for the processes of the present invention in embodiments may be of any type capable of maintaining three distinct levels of potential; layered imaging members with a charge generating and a charge transport layer, reference U.S. Pat. Nos. 4,265,990; 4,585,884; 4,584,253; 4,563,408 and the like, the disclosures of which are totally incorporated herein by reference; selenium, selenium alloys and the like. Also, various dielectric or photoconductive insulating material suitable for use in xerographic, ionographic, or other electrophotographic processes may be used, such as amorphous silicon.

In embodiments, reference for example trilevel imaging processes, the photoresponsive imaging member can be negatively charged, positively charged, or both, and the latent image formed on the surface may be comprised of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can consist of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

The latent image comprising three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a trilevel charge pattern may be formed by means of a raster output scanner, optically modulating laser light as it scans a uniformly charged photoconductive imaging member. In this embodiment, the areas of high potential are formed by by exposing the imaging member to the light source at partial power, and the areas of low potential are formed by exposing the imaging member to the light source at full power. Other electrophotographic and ionographic methods of generating latent images are also acceptable. Generally, the highlighted areas of the image are developed with a developer having a color other than black, while the remaining portions of the image are developed with a black developer. In general, the highlighted color portions are developed first to minimize the interaction between the two developers thereby maintaining the high quality of the black image.

Development can be generally accomplished by the magnetic brush development process disclosed in U.S. Pat. No. 2,874,063, the disclosure of which is totally incorporated herein by reference. This method entails the transporting of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred wherein the developer comprises conductive carrier particles and is capable of conducting an electric field between the biased magnet through the carrier particles to the photoreceptor. Conductive magnetic brush development can be generally employed in view of the relatively small development potentials of around 200 volts that are generally available for the process; conductive development ensures that sufficient toner is presented on the photoreceptor under these development potentials to result in acceptable image density. Conductive development is also preferred to ensure that fringe fields occurring around the edges of images of one color are not developed by the toner of the other color.

During the development process, the developer housings can be biased to a voltage between the level of potential being developed and the intermediate level of charge on the imaging member. For example, if the latent image comprises a high level of potential of about −800 volts, an intermediate level of potential of about −400 volts, and a low level of about −100 volts, the developer housing containing the positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges.

The developed image can then be transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

With further reference to the carrier particles, especially for selection in color xerography the carrier for the developers of the present invention generally comprises ferrite, iron or a steel core, preferably unoxidized, such as Hoeganoes Anchor Steel Grit, with an average diameter of from about 25 to about 215 microns, and preferably from about 50 to about 150 microns. These carrier cores can be coated with a solution coating of methyl terpolymer, reference for example U.S. Pat. Nos. 3,467,634 and 3,526,533, the disclosures of which are totally incorporated herein by reference, containing from 0 to about 40 percent by weight of conductive particles, such as carbon black like BLACK PEARLS®, and other similar known carbon blacks available for this purpose from, for example, Cabot Corporation. Also, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier and preferably about 1 percent by weight of the carrier. Another carrier coating for the carrier of the colored developer comprises a blend of from about 35 to about 65 percent by weight of polymethylmethacrylate and from about 35 to about 65 percent by weight of chlorotrifluoroethylene-vinyl chloride copolymer, commercially available as OXY 461® from Occidental Petroleum Company and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier.

Preferably, the carrier coatings are placed on the carrier cores by a solution coating process.

Suitable colored, excludes black, toner pigments include SUDAN BLUE OS®, commercially available from BASF, NEOPAN BLUE®, commercially available from BASF, PV FAST BLUE®, commercially available from BASF, cyan, magenta, yellow, red, brown, blue or mixtures thereof, reference for example U.S. Pat. No. 4,883,736, the disclosure of which is totally incorporated herein by reference. Generally, the pigment is present in an effective amount of from, for example, about 1 to about 15 percent by weight, and preferably from about 1 to about 3 percent by weight.

For the black developers comprised of toner with a pigment such as carbon black, which developers can be comprised of similar components as the aforementioned colored developers with the exceptions that a black instead of colored pigment is selected, and the charge enhancing additive is a positive charge additive and is other than an aluminum hydroxide, such as an alkyl pyridinium chloride like cetyl pyridinium chloride, which are present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganoes Anchor Steel Grit, with an average diameter of from about 25 to about 215 microns, and preferably from about 50 to about 150 microns with a coating of chlorotrifluoroethylene-vinyl chloride copolymer, commercially available as OXY 461® from Occidental Petroleum Company, which coating contains from 0 to about 40 percent by weight of conductive particles homogeneously dispersed in the coating at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as TEDLAR® from E.I. Du Pont de Nemours and Company, present in a coating weight of from about 0.01 to about 0.2, and preferably about 0.05 percent by weight of the carrier. The polyvinyl fluoride coating is generally coated onto the core by a powder coating process wherein the carrier core is coated with the polyvinyl fluoride in powder form and subsequently heated to fuse the coating. In one preferred embodiment, the carrier comprises an unoxidized steel core which is blended with polyvinyl fluoride (TEDLAR®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$ (ohm-cm)$^{-1}$. Optionally, an additional coating of polyvinylidene fluoride, commercially available as KYNAR® from Pennwalt Corporation, may be powder coated on top of the first coating of the carrier in the black developer at a coating weight of from about 0.01 to about 0.2 percent by weight. The carrier for the black developer generally has a conductivity of from about $10^{-14}$ to about $10^{-7}$, and preferably from about $10^{-12}$ to about $10^{-9}$ (ohm-cm)$^{-1}$.

Examples of toner resins, especially for the black toner, include polyesters, styrene-butadiene polymers, styrene acrylate polymers, and styrene-methacrylate polymers, and particularly styrene-n-butylmethacrylate copolymers wherein the styrene portion is present in an effective amount of, for example, from about 50 to about 65 percent by weight, preferably about 65 percent by weight, and the n-butylmethacrylate portion is present in an amount of from about 20 to about 50 percent by weight, preferably about 42 percent by weight. Generally, the resin is present in an amount of from about 80 to about 98.8 percent by weight, and preferably in an amount of 92 percent by weight. Suitable pigments include those such as carbon black, including REGAL 330® commercially available from Cabot Corporation, nigrosine, and the like, reference for example U.S. Pat. No. 4,883,376, the disclosure of which is totally incorporated herein by reference. Generally, the pigment is present in an amount of from about 1 to about 15 percent by weight, and preferably in an amount of about 6 percent by weight. With respect to the toner containing a black pigment such as carbon black, magnetite or mixtures thereof, there are selected as the charge enhancing additive alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference, distearyl dimethyl ammonium methyl sulfate (DDAMS), reference U.S. Pat. No. 4,560,635, the disclosure of which is totally incorporated herein by reference, and the like. This toner usually possesses a positive charge of from about 10 to about 45 microcoulombs per gram and preferably from about 5 to about 25 microcoulombs per gram, which charge is dependent on a number of known factors as is the situation with the color developer including the amount of charge enhancing additive present and the exact composition of the other compositions, such as the toner resin, the pigment, the carrier core, and the coating selected for the carrier core, and an admix time of from about 15 to about 60 seconds and preferably from about 15 to about 30 seconds. These additives are present in various effective amounts of, for example, from about 0.1 to about 20 weight percent and preferably from about 1 to about 10 weight percent. In the preparation of the colored and toner compositions, normally the products obtained comprised of toner resin, pigment and charge enhancing additive can be subjected to micronization, including classification, which classification is primarily for the purpose of removing undesirable fines and substantially very large particles to enable, for example, toner particles with an average volume diameter of from about 5 to about 25 microns and preferably from about 9 to about 15 microns.

In addition, external additives of colloidal silica, such as AEROSIL® R972, AEROSIL® R976, AEROSIL® R812, and the like, available from Degussa, and metal salts or metal salts of fatty acids, such as zinc stearate, magnesium stearate, aluminum stearate, cadmium stearate, and the like, may be blended on the surface of the colored and black toners. Toners with these additives blended on the toner surface are disclosed in the prior art such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably about 0.3 percent by weight of the toner, and the stearate is present in an amount of from about 0.1 to about 2 percent by weight, and preferably about 0.3 percent by weight, of the toner. Varying the amounts of these two external additives enables adjustment of the charge levels and conductivities of the toners. For example, increasing the amount of silica generally adjusts the triboelectric charge in a negative direction and improves admix times, which are a measure of the amount of time required for fresh toner to become triboelectrically charged after coming into contact with the carrier. In addition, increasing the amount of stearate improves admix times, renders the developer composition more conductive, adjusts the triboelectric charge in a positive direction, and improves humidity insensitivity.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer.

The black toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as UNILIN TM. The linear polymeric alcohol is generally present in an amount of from about 0.1 to about 1 percent by weight of the toner.

Developer compositions for the present invention in embodiments comprise from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight of toner and about 35 percent by weight of carrier. The triboelectric charge of the black toners generally is from about +10 to about +30, and preferably from about +13 to about +18 microcoulombs per gram, although the value may be outside of this range. Particle size of the black toners is generally from about 8 to about 13 microns in volume average diameter, and preferably about 11 microns in volume average diameter although the value may be outside of this range, provided that the objectives of the present invention are achieved.

Coating of the carrier particles of the present invention may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight is achieved.

The toners of the present invention may be prepared by processes such as extrusion, which is a continuous process that entails dry blending the resin, pigment, and charge control additive, placing them into an extruder, melting and mixing the mixture, extruding the material, and reducing the extruded material to pellet form. The pellets can be further reduced in size by grinding or jetting, and are then classified by particle size. In an embodiment of the present invention, toner compositions with an average particle size of from about 10 to about 25, and preferably from 10 to about 15 microns can be selected. External additives such as linear polymeric alcohols, silica, or zinc stearate can then be blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Other known toner preparation processes can be selected including melt mixing of the components in, for example, a Banbury, followed by cooling, attrition and classification.

The colored and black toners can be comprised of the same or similar toner resins, pigments, and surface additives, and in the same or similar amount ranges, or specific amounts indicated herein.

Specific embodiments of the invention will now be described in detail. These examples are intended to be illustrative, and the invention is not limited to the materials, conditions, or process parameters set forth in these embodiments. All parts and percentages are by weight unless otherwise indicated. A comparative Example is also provided.

EXAMPLE I

Synthesis of Hydroxy Bis[3,5-Tertiary Butyl Salicylic] Aluminate Monohydrate at Elevated Temperature:

To a solution of 12 grams (0.3 mole) NaOH in 500 milliliters of water were added 50 grams (0.2 mole) di-tert-butyl salicylic acid. The resulting mixture was heated to 60° C. to dissolve the acid. A second solution was prepared from dissolving 33.37 grams (0.05 mole) of aluminum sulfate, $Al_2(SO_4)_3.18H_2O$, into 200 milliliters of water with heating to 60° C. The former solution containing the sodium salicylate salt was added rapidly and dropwise into the latter aluminum sulfate salt solution with stirring. When the addition was complete the reaction mixture was stirred an additional 5 to 10 minutes at 60° C. and then cooled to room temperature, about 25° C. The mixture was then filtered and the collected solid product was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample of the product obtained was analyzed for water of hydration by Karl-Fischer titration after drying for an additional 24 hours at 100° C. in a vacuum, the sample contained 2.1 percent weight of water. The theoretical value calculated for a monohydrate is 3.2 percent weight of water.

Infrared spectra of the above product hydroxy bis[3,5-tertiary butyl salicylic] aluminate monohydrate indicated the absence of peaks characteristic of the starting material di-tert-butyl salicylic acid and indicated the presence of a Al—OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared monohydrate.

Elemental Analysis Calculated for $C_{30}H_{41}O_7Al$: C, 66.25; H, 7.62; Al, 5.52. Calculated for $C_{30}H_{41}O_7Al.1\text{-}H_2O$: C, 64.13; H, 7.74; Al, 4.81. Found: C, 64.26; H, 8.11; Al, 4.67.

EXAMPLE II

Synthesis of Hydroxy Bis[3,5-Tertiary Butyl Salicylic] Aluminate Hydrate at Room Temperature The procedure of Example I was repeated with the exception that the mixing of the two solutions and subsequent stirring was accomplished at room temperature, about 25° C. The product was isolated and dried as in Example I, and identified as the above hydroxy aluminum complex hydrate by IR.

EXAMPLE III

A toner was prepared as follows: 94.5 parts of styrene/butadiene copolymer (91/9), 4.5 parts of PV FAST BLUE ® pigment obtained from Hoechst Celanese and 1 part of the hydroxy aluminum compound obtained by the process of Example I were melt blended in an extruder followed by micronization and air classification to yield toner sized particles of 10 microns in volume average diameter. Carrier particles were prepared by solution coating a Hoeganoes Anchor Steel core with a particle diameter range of from about 75 to about 150 microns, available from Hoeganoes Company, with 1 part by weight of a coating comprising 20 parts by weight of VULCAN ® carbon black, available from Cabot Corporation, homogeneously dispersed in 80 parts by weight of polymethylmethacrylate, which coating was solution coated from toluene. A developer was prepared by taking 3 parts of the above prepared toner and blending it with 100 parts of the above prepared carrier by roll milling for a period of about 30 minutes which resulted in a developer with a toner exhibiting a triboelectric charge of −17.7 microcoulombs per gram as measured in a Faraday Cage.

EXAMPLE IV

A toner was prepared as follows: 92.5 parts of styrene/butadiene copolymer (91/9), 4.5 parts of PV FAST BLUE ® pigment obtained from Hoechst Celanese and 3 parts of the hydroxy aluminum compound of Example II were melt blended in an extruder followed by micronization and air classification to yield toner size particles of 10 microns in volume average diameter. A developer was prepared by taking 3 parts of this toner and blending it with 100 parts of the carrier of Example III by roll milling for a period of about 30 minutes which resulted in a developer with a toner exhibiting a triboelectric charge of −20 microcoulombs per gram as measured by the known Faraday Cage process.

EXAMPLE V

A toner was prepared by repeating the procedure of Example IV except that 3 parts of an aluminum compound of 3,5 di-t-butylsalicylic acid prepared according to U.S. Pat. No. 4,845,003, reference Example I, was used in place of the hydroxy aluminum compound of Examples I and II. A developer was prepared by mixing 3 parts of the toner and blending it with 100 parts of the carrier of Example III by roll milling for a period of about 30 minutes, which resulted in a developer with a toner exhibiting a triboelectric charge of −24 microcoulombs per gram as measured by the known Faraday Cage process.

EXAMPLE VI

A charge spectrograph analysis of the developer in Example IV, measured at 75 volts/centimeter, resulted in 3.82 percent corrected wrong (positive charge) sign toner (CWS) and 12.79 percent corrected low charge (CLC) toner. Charge spectrograph analysis of the developer of Example V, measured at 75 volts/centimeter, resulted in 5.38 percent corrected wrong sign (CWS) toner and 20.28 percent corrected low charge toner (CLC). This indicates a significant improvement in the charging properties of the hydroxy aluminate compound toner of the instant invention as compared to the toner with the aluminum compound of 3,5 di-t-butyl salicylic acid prepared according to U.S. Pat. No. 4,845,003. The aluminum compound prepared according to U.S. Pat. No. 4,845,003 resulted in a CLC that is 59 percent higher and a CWS that is 41 percent higher than the toner of the present invention with hydroxy bis[3,5 di-t-butyl.salicylic] aluminate compound prepared according to Example I and Example II of the present invention. The higher values observed for CLC and CWS of the comparative aluminum compound would normally translate into higher image background and higher toner consumption in xerographic imaging test fixtures similar to the Xerox Corporation 5090 TM.

EXAMPLE VII

A toner was prepared as follows: 97.0 parts of a bisphenol fumarate polyester resin, 2 parts of PV FAST BLUE ® pigment, and 1 part of the hydroxy aluminum compound of Example I were melt blended in an extruder followed by micronization and air classification to yield toner size particles by repeating the process of Example III affording a toner having a 30 minute roll mill tribo of −14 microcoulombs/gram as measured by the known Faraday Cage process.

EXAMPLE VIII

A toner was prepared as follows: 95.0 parts of a bisphenol fumarate polyester resin, 2 parts of PV FAST BLUE ® pigment, and 3 parts of the hydroxy aluminum compound of Example I were melt blended in an extruder followed by micronization and air classification to yield toner size particles of 10 microns in volume average diameter. A developer was prepared as described in Example III affording a toner having a 30 minute roll mill tribo of −25.5 microcoulombs/gram as measured by the known Faraday Cage process.

EXAMPLE IX

The developer of Example IV was incorporated in a Xerox Model 5028 TM machine fixture and operated in a continuous throughput mode for a period of about 25 hours producing in excess of 200,000 prints. The developer composition exhibited excellent tribo stability throughout the test, that is tribo values were in the range of about 18 to 22, and background deposits on the photoreceptor were very low as determined by optical density measurements obtained from Scotch tape transfer of residual wrong sign toner material remaining on the photoreceptor. There was observed virtually no residual toner on the photoreceptor, that is an optical density of less than about 0.01 was measured with a densitometer on the transfer tape.

EXAMPLE X

The developer of Example IV was found to be environmentally stable for triboelectric charge levels through relative humidity zones of from about 20 percent to about 80 percent resulting in triboelectric charge levels of from about −20 microcoulombs/gram to about −17 microcoulombs/gram as determined in a Faraday Cage.

EXAMPLE XI

The toner of Example VIII is surface blended with 0.3 percent of AEROSIL R972® obtained from Degussa and 0.3 percent of zinc stearate available from Synthetic Products in a roll mill for about 30 minutes. A developer is prepared with this surface blended toner and the carrier of Example III at a 3 weight percent toner concentration. This developer is incorporated in a Xerox Model 5028 TM machine fixture and is operated in a continuous throughput mode for a period of about 25 hours producing in excess of 200,000 prints. The developer composition exhibits excellent tribo stability throughout the test, that is tribo values are in the range of about 18 to 22, and background deposits on the photoreceptor were very low as determined by optical density measurements obtained from Scotch tape transfer of residual wrong sign (positive) toner material remaining on the photoreceptor. There was observed virtually no residual toner on the photoreceptor.

EXAMPLE XII

A toner is prepared as follows: 98 parts of a bisphenol fumarate polyester resin, and 2 parts of PV FAST BLUE® pigment are melt blended in an extruder followed by micronization and air classification to yield toner size particles of 10 microns in volume average diameter. The toner is then surface blended with 0.3 weight percent of zinc stearate available from Synthetic Products and 0.3 weight percent of AEROSIL R972® from Degussa that is surface treated with 15 weight percent of the hydroxy aluminate charge enhancing additive compound of Example XI. The additives are blended in a roll mill onto the toner surface as in Example I. A developer is prepared with this surface blended toner and the carrier of Example III at a 3 weight percent toner concentration. This developer is incorporated in a Xerox Model 5028 TM machine fixture and operated in a continuous throughput mode for a period of about 25 hours producing in excess of 200,000 prints. The developer composition exhibits excellent tribo stability throughout the test, that is tribo values were in the range of about 18 to 22, and background deposits on the photoreceptor are very low as determined by optical density measurements obtained from Scotch tape transfer of residual wrong sign toner material remaining on the photoreceptor. There was observed virtually no residual toner on the photoreceptor.

EXAMPLE XIII

A toner is prepared as follows: 95.5 parts of an emulsion polymerized styrene/butadiene resin (89/13), and 4.5 parts of PV FAST BLUE® pigment are melt blended in an extruder followed by micronization and air classification to yield toner size particles of 10 microns in volume average diameter. The toner is then surface blended with 0.3 of percent zinc stearate available from Synthetic Products and 0.3 percent of $TiO_2$ available from Degussa that has been surface treated with 15 weight percent of the hydroxy aluminum dialkyl salicylate compound of Example I. The additives are blended onto the toner surface as in Example XI. A developer is prepared with this surface blended toner and the carrier described in Example III at a 3 weight percent toner concentration. This developer is incorporated in a machine fixture and run in a continuous throughput mode for a period of about 25 hours affording excellent tribo stability.

In embodiments, the charge additives may be comprised of mixtures of the unhydrated and hydrated components.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner composition consisting of resin, pigment and a charge enhancing additive of the formulas

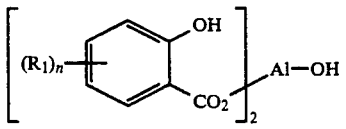

or

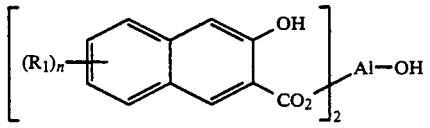

wherein $R_1$ is selected from the group consisting of hydrogen and alkyl, and n is zero, 1, 2, 3, or 4.

2. A toner in accordance with claim 1 wherein alkyl contains from 1 to about 25 carbon atoms.

3. A toner in accordance with claim 1 wherein $R_1$ is hydrogen, methyl, ethyl, propyl, and n is 0, 1, 2, 3, or 4.

4. A toner in accordance with claim 1 wherein $R_1$ is hydrogen, isopropyl, or isobutyl, and n is zero, 1, 2, 3, or 4.

5. A toner in accordance with claim 1 wherein the pigment is carbon black.

6. A toner in accordance with claim 1 wherein the pigment is cyan, magenta, yellow, or mixtures thereof.

7. A toner in accordance with claim 1 wherein the pigment is red, blue, green or brown.

8. A toner in accordance with claim 1 wherein the resin is a styrene acrylate, a styrene methacrylate, or a styrene butadiene.

9. A toner in accordance with claim 1 wherein the resin is a styrene butylmethacrylate, or a suspension polymerized styrene butadiene.

10. A toner in accordance with claim 1 wherein the resin is present in an amount of from about 75 to about 95 weight percent.

11. A toner in accordance with claim 1 wherein the resin is present in an amount of from about 85 to about 95 weight percent.

12. A toner in accordance with claim 1 wherein the pigment is present in an amount of from about 5 to about 20 weight percent.

13. A toner in accordance with claim 1 wherein the pigment is present in an amount of from about 10 to about 15 weight percent.

14. A developer comprised of the toner of claim 1 and carrier particles.

15. A developer in accordance with claim 14 wherein the carrier is comprised of steel or ferrites.

16. A developer in accordance with claim 15 wherein the carrier is comprised of steel, or ferrites.

17. A developer in accordance with claim 14 wherein the carrier contains a coating.

18. A developer in accordance with claim 14 wherein the carrier contains a polymeric coating.

19. A toner in accordance with claim 1 containing surface additives selected from the group consisting of metal salts, metal salts of fatty acids, colloidal silicas, and mixtures thereof.

20. A toner in accordance with claim 19 wherein the surface additive is zinc stearate.

21. A toner in accordance with claim 19 wherein the surface additive is a colloidal silica comprised of an AEROSIL ®.

22. A toner in accordance with claim 1 wherein there is selected the monohydrate, the dihydrate, the trihydrate, or the tetrahydrate of said additive.

* * * * *